US006581624B1

(12) United States Patent
Magami et al.

(10) Patent No.: US 6,581,624 B1
(45) Date of Patent: Jun. 24, 2003

(54) AUTOMATIC PRESSURIZED FLUID SWITCHING DEVICE

(76) Inventors: Mitsuharu Magami, 3243-6, Asahigaokacho, Hanamigawa-ku, Chiba-shi, Chiba (JP), 262-0017; Naoyuki Magami, 3243-6, Asahigaokacho, Hanamigawa-ku, Chiba-shi, Chiba (JP), 262-0017; Takuya Magami, 3243-6, Asahigaokacho, Hanamigawa-ku, Chiba-shi, Chiba (JP), 262-0017

( * ) Notice: Subject to any disclaimer, the term of this patent is extended or adjusted under 35 U.S.C. 154(b) by 0 days.

(21) Appl. No.: 09/958,662

(22) PCT Filed: Apr. 13, 1999

(86) PCT No.: PCT/JP99/01959

§ 371 (c)(1),
(2), (4) Date: Oct. 12, 2001

(87) PCT Pub. No.: WO00/61949

PCT Pub. Date: Oct. 19, 2000

(51) Int. Cl.[7] ..... F15B 13/042; F16K 31/122
(52) U.S. Cl. ..... 137/119.01; 137/624.14
(58) Field of Search ..... 137/119.01, 624.14, 137/624.18, 104, 105, 99

(56) References Cited

U.S. PATENT DOCUMENTS 3,260,212 A * 7/1966 Johnson ..... 137/99
3,791,768 A * 2/1974 Wanner ..... 137/99
4,572,331 A * 2/1986 Powell et al. ..... 137/624.18

FOREIGN PATENT DOCUMENTS

| | | |
|---|---|---|
| JP | 28-5844 | 11/1953 |
| JP | 51-24480 | 2/1976 |
| JP | 60-263708 | 12/1985 |
| JP | 01-250604 | 10/1989 |

* cited by examiner

*Primary Examiner*—Stephen M. Hepperle
(74) *Attorney, Agent, or Firm*—Wenderoth, Lind & Ponack, L.L.P.

(57) ABSTRACT

An automatic pressurized fluid switching device performs a switching using pressurized fluid rather than electrical elements, and comprises a pressurized-fluid inlet port, plural pressurized-fluid outlet ports, a switching valve for switching between outlet ports, a pilot valve for piloting the valve switching operation, and a reaction member for controlling the pilot valve in response to pressure of the pressurized fluid introduced. The pilot valve includes a first pilot unit controlled only by the reaction member, and a second pilot unit controlled by the reaction member in its initial and final stages and directly by the pressurized fluid in its middle stage, whereby the second pilot unit in the middle stage is reliably controlled even with little pressurized fluid introduced when again operated after an intermediate stoppage.

3 Claims, 5 Drawing Sheets

AUTOMATIC PRESSURIZED FLUID SWITCHING DEVICE

TECHNICAL FIELD

This invention relates to a device for automatically switching a plurality of outlet ports from which pressurized fluid is discharged.

To be more specific, this invention relates to an automatic pressurized fluid switching device for performing a switching operation using the pressure of pressurized fluid in itself without using electrical elements.

BACKGROUND ART

As a conventional technique for automatically switching discharge of high pressure fluid such as oil and air from outlet ports, there has been known a device using electrical elements such as an electromagnetic valve and so on (cf. Japanese Patent Publication SHO 46-20414(B)). However, the conventional device entails problem such as lack of versatility, since the electrical elements have restrictions on applicability.

There has been known another device incorporating various mechanical valve systems which operate with the pressure of pressurized fluid. However, this conventional device has a possibility that a smooth switching operation cannot securely be effected when being again operated after stopping at an intermediate point of the switching action. To solve the problem noted above, the conventional device is provided with a valve mechanism or a mechanism for producing an expansion force by the pressurized fluid so as to smoothly carry out infallibly the switching operation with the expansion force of the pressurized fluid, resulting in complexity of the overall structure.

DISCLOSURE OF THE INVENTION

The present invention was made in the light of the foregoing problems, and has an object to provide an automatic pressurized fluid switching device having an excellent switching performance without using an electrical element so as not to be complicated in structure.

As set forth in claim 1, a solution of the technical problems as described above is to provide an automatic pressurized fluid switching device comprising an inlet port for introducing pressurized fluid, a plurality of outlet ports for discharging the pressurized fluid, a switching valve disposed between the inlet port and the outlet ports for switching over the outlet ports, a pilot valve for piloting the switching operation of the switching valve, and a reaction member for controlling the pilot action of the pilot valve in response to the pressure of the pressurized fluid introduced, which is characterized in that the pilot valve is provided with a first pilot unit in which the pilot action of the pilot valve is controlled only by the reaction member, and a second pilot unit in which the pilot action of the pilot valve is controlled by the reaction member in its initial and final stages and directly by the pressurized fluid in its middle stage.

According to the solution of the technical problems described above, two lineages of the pilot action of the pilot valve for piloting the switching action of the switching valve can be constituted.

Thus, the lineages are formed of the pilot action controlled only by the reaction member in the first pilot unit and the pilot action controlled by both of the reaction member and the fluid in the second pilot unit. The pilot action in the second pilot unit is controlled by the reaction member in the initial and final stages and by the pressurized fluid in the middle stage. In other words, the pilot action in the second pilot unit in the middle stage is left free from the controlling of the reaction member.

Consequently, the pilot action in the second pilot unit in the middle stage can be securely effected even when the pressurized fluid introduced thereinto is little at the time of being again operated after stopping at the intermediate point of the switching action. Thus, smooth switching action can be performed securely. There is however no call for providing a mechanism for producing expansive power on the pressurized fluid.

As a result, a simple automatic pressurized fluid switching device having excellent switching performance can be fulfilled without using electrical elements.

The automatic pressurized fluid switching device provided as another solution of the aforesaid technical problems as set forth in claim 2 is featured in that the reaction member in the structure set forth in claim 1 comprises an operating piston mounted in a reciprocative sidable state within an operating chamber formed between the inlet port and the outlet port, each of the first pilot units of the pilot valve comprises a push rod having a front portion which protrudes into the operating chamber to come in touch with the operating piston, a flange formed in the middle of the push rod, and a pilot piston mounted at the rear portion to receive the pressure of the pressurized fluid, and each of the second pilot units of the pilot valve is formed of a sleeve fitted sidably in the rear portion side of the push rod, wherein the sleeve is shorter than the length from the flange of the push rod to the rear end thereof so as to control the pressure of the pressurized fluid applied to the switching valve.

According to this solution, the reaction member can be formed of the operating piston of a reciprocating type, which is simplest in structure. Thus, the automatic pressurized fluid switching device can be made simple in structure. Furthermore, the first and second pilot units of the pilot valve are arranged coaxially, so that they can be assembled compact. Consequently, the structure of the device can be made more simple.

As set forth in claim 3, the other solution of the technical problems described above is featured in that the reaction member in the structure set forth in claim 1 comprises an operating piston mounted in a reciprocative sidable state within an operating chamber formed between the inlet port and the outlet port, each of the first pilot units of the pilot valve comprises a push rod having a front portion which protrudes into the operating chamber to come in touch with the operating piston, a flange formed in the middle of the push rod, and a pilot piston mounted at the rear portion to receive the pressure of the pressurized fluid, and each of the second pilot units of the pilot valve is formed of a sleeve fitted sidably in the rear portion side of the push rod, wherein the sleeve is slightly shorter than the length from the vicinity of the front portion to the rear portion of the push rod of the first pilot unit so as to control the pressure of the pressurized fluid applied to the switching valve.

According to this solution, the reaction member can be formed of the operating piston of a reciprocating type, which is simplest in structure. Thus, the automatic pressurized fluid switching device can be made simple in structure. Furthermore, the first and second pilot units of the pilot valve are arranged coaxially within a double structure, so that they can be assembled compact. Consequently, the structure of the device can be made more simple.

BEST MODE FOR CARRYING OUT THE INVENTION

Figure 1:
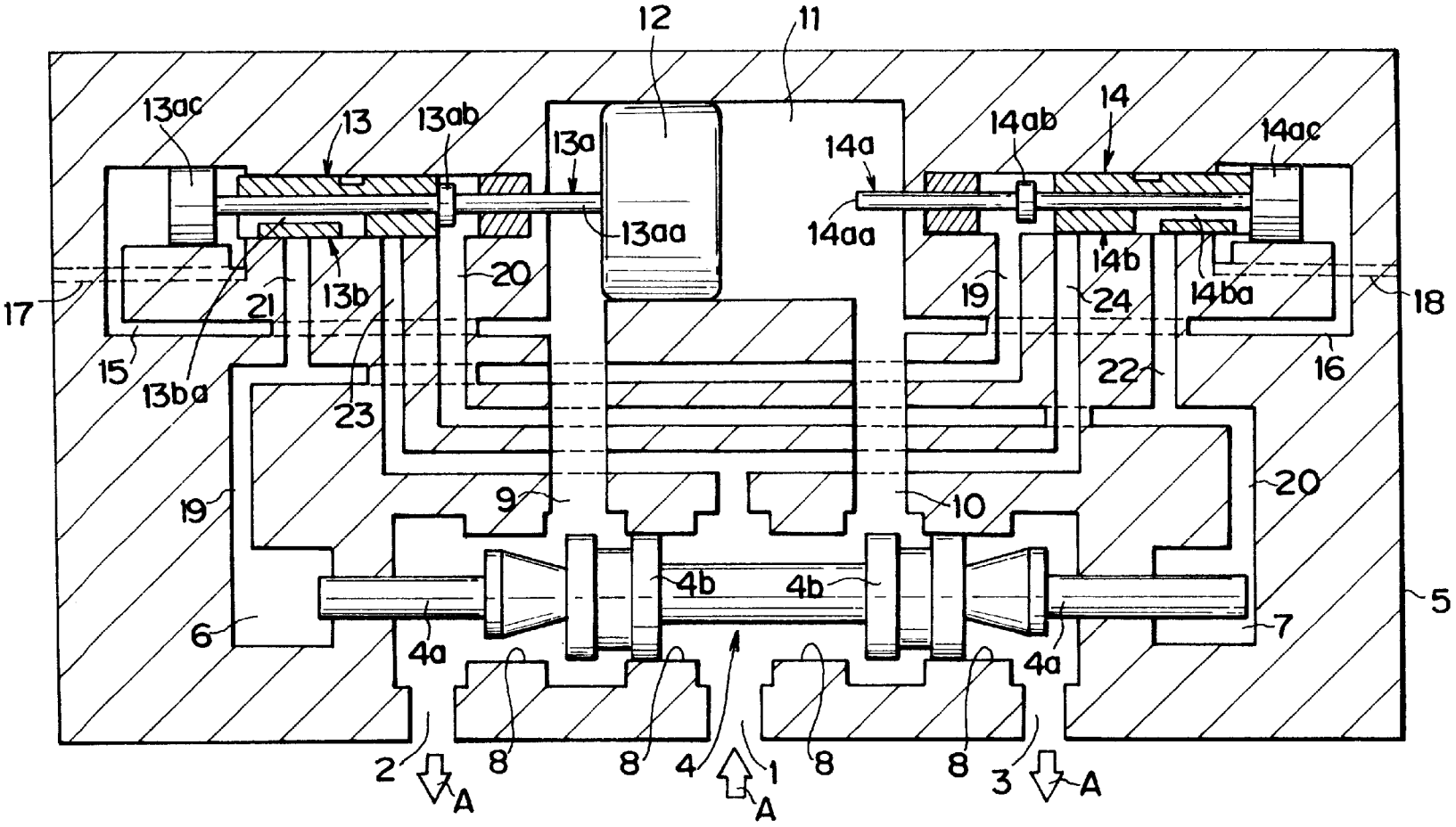
FIG. 1 is a sectional view showing a first embodiment of the best mode for carrying out the automatic pressurized fluid switching device according to the present invention.
Figure 2:
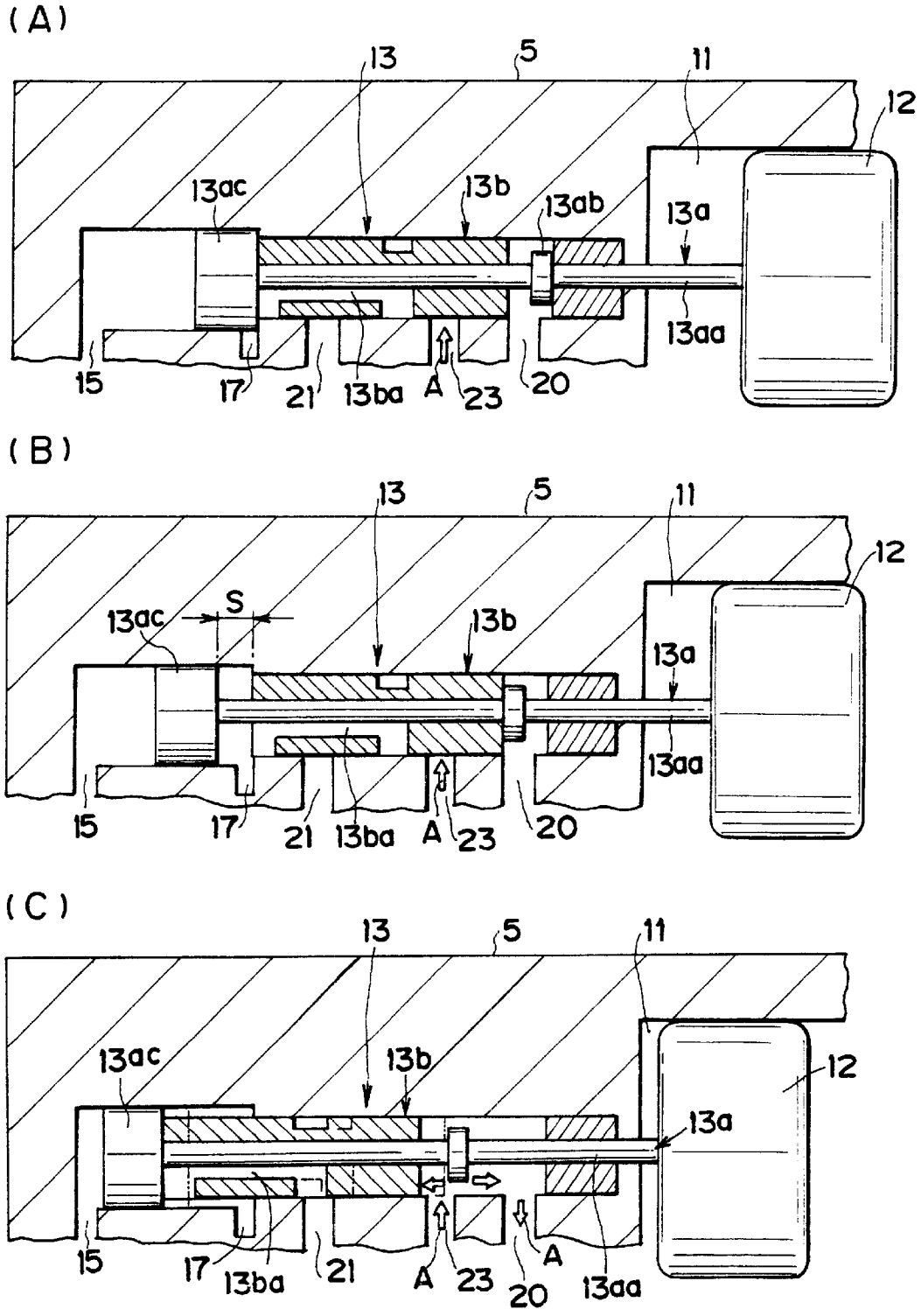
FIG. 2 is an illustration of the principal portion of FIG. 1, showing the sequence of operation of the device in the order of (A) to (C).

The best mode for carrying out the automatic pressurized fluid switching device according to the invention will be described hereinafter with reference to the accompanying drawings.

FIG. 1 through FIG. 4 show a first embodiment of the invention.

The illustrated device comprises one inlet port 1 for introducing pressurized fluid A, and two outlet ports 2 and 3 for discharging the pressurized fluid A.

There is adopted a switching valve 4 of a spool type having a shaft 4*a* and lands 4*b*. The shaft 4*a* of the switching valve 4 has both end portions inserted into pressure chambers 6 and 7 formed in a housing 5 and supported by the housing 5 in a sidable state. Each of the end portions of the shaft 4*a* receives the pressure of pressurized fluid selectively supplied to one of the pressure chambers 6 and 7 at a time. The lands 4*b* are in disjunctive contact with seats 8 formed within the housing 5, so that two main passages 9 and 10 communicating with the inlet port 1 and outlet ports 2 and 3 can be intermittently switched over to each other.

The two main passages 9 and 10 communicate with an operating chamber 11 formed in the housing 5.

In the operating chamber 11, there is contained an operating piston 12 serving as a reaction member which is sidably moved by the pressure of the pressurized fluid A. The two main passages 9 and 10 are divided by the operating piston 12 within the operating chamber 11.

On both sides of the operating piston 12 (operating chamber 11), there are disposed a pair of pilot valves 13 and 14.

The pilot valves 13 and 14 have first pilot units 13*a* and 14*a*, and second pilot units 13*b* and 14*b*, respectively. The first pilot units 13*a* and 14*a* comprise push rods 13*aa* and 14*aa* each having a round cross-section, which rods each have a front portion protruding into the operating chamber 11 to come in touch with the operating piston 12, plate-like flanges 13*ab* and 14*ab* formed in the middle of the push rod 13*aa*, and pilot pistons 13*ac* and 14*ac* connected to or brought in contact with the rear portions of the push rods 13*aa* and 14*aa*. The second pilot units 13*b* and 14*b* of the pilot valve are each formed of a sleeve fitted slidably in the rear portion side of the push rod, wherein the sleeve is shorter than the length from the flange 13*ab* or 14*ab* of the push rod 13*aa* or 14*aa* to the rear end thereof. In the rear portion sides of the pilot units, there are formed discharge ports 13*ba* and 14*ba*.

The pilot pistons 13*ac* and 14*ac* of the first pilot units 13*a* and 14*a* are opposed to pilot passages 15 and 16 leading to the main passages 9 and 10. Consequently, the pilot pistons 13*ac* and 14*ac* each receive the pressure of the pressurized fluid A in the main passages 9 and 10.

The discharge ports 13*ba* and 14*ba* of the second pilot units 13*b* and 14*b* can selectively communicate with discharge passages 17 and 18 leading to the outside of the housing 5 or pressure release passages 21 and 22 diverged from pressure passages 19 and 20. Incidentally, the pressure passages 19 and 20 are connected with voids formed in the front end sides of the second pilot units 14*b* and 13*b* of the opposed pilot valves 14 and 13.

With passages formed between the pressure passages 20 and 19 and the pressure release passages 21 and 22, pressure supplying passages 23 and 24, which always communicate with the inlet port 1, are connected.

The pressure passages 20 and 19 and the pressure supplying passages 23 and 24 are arranged so as to communicate with each other through the voids formed in the front end sides of the second pilot units 13*b* and 14*b* when the second pilot units 13*b* and 14*b* of the pilot valve 13 move backward.

According to this embodiment, the device can be made simple in structure because it has no need of relying on any electrical element such as an electromagnetic valve nor causing the pressurized fluid to produce an expansion force. Thus, a highly versatile pressurized fluid switching device without having restrictions in applicability can be fulfilled.

As shown in FIG. 1, the switching operation in this embodiment is carried out by introducing the pressurized fluid A into the right main passage 10 communicating with the inlet port 1 to forcibly slide the operating piston 12 leftward within the operating chamber 11 in the state of switching the switching valve 4 rightward (in the drawing). Thus, the pressurized fluid A is discharged from the left outlet port 2. The light outlet port 3 is closed by the switching valve 4.

At this time, the operating piston 12 thrusts the push rod 13*aa* of the first pilot unit 13*a* of the left pilot valve 13 in the initial stage as shown in FIG. 2(B). Thus, the entire first pilot unit 13*a* moves backward. However, the second pilot unit 13*b* is remained in its rest state slidably pushed by the push rod 13*aa*. As a result, between the pilot piston 13*ac* of the first pilot unit 13*a* and the rear end side of the second pilot unit 13*b*, there is formed a space S.

The subsequent sliding motion of the operating piston 12 involves moving the second pilot unit 13*b* by means of the flange 13*ab* of the first pilot unit 13*a*. Consequently, the entire pilot valve 13 (first pilot unit 13*a* and second pilot unit 13*b*) integrally moves backward.

The further subsequent sliding motion of the operating piston 12 in its middle stage involves introducing the pressurized fluid A into the front side chamber of the second pilot unit 13*b* by moving the front end of the second pilot unit 13 backward behind the pressure supplying passages 23, as shown in FIG. 2(C). Consequently, the second pilot unit 13*b* is moved backward by the pressurized fluid A at higher speed than the first pilot unit 13*a*. The backward movement of the second pilot unit 13*b* slows down due to collision with the pilot piston 13*ac* of the first pilot unit 13*a* (disappearance of the space S).

The further sliding motion of the operating piston 12 continues to push the push rod 13*aa* of the first pilot unit 13*a* in the final stage. The second pilot unit 13*b* is also continued to move backward due to the pressure of the pressurized fluid A. Consequently, the entire pilot valve 13 (first and second pilot units 13*a* and 13*b* in one body) moves backward.

Figure 3:
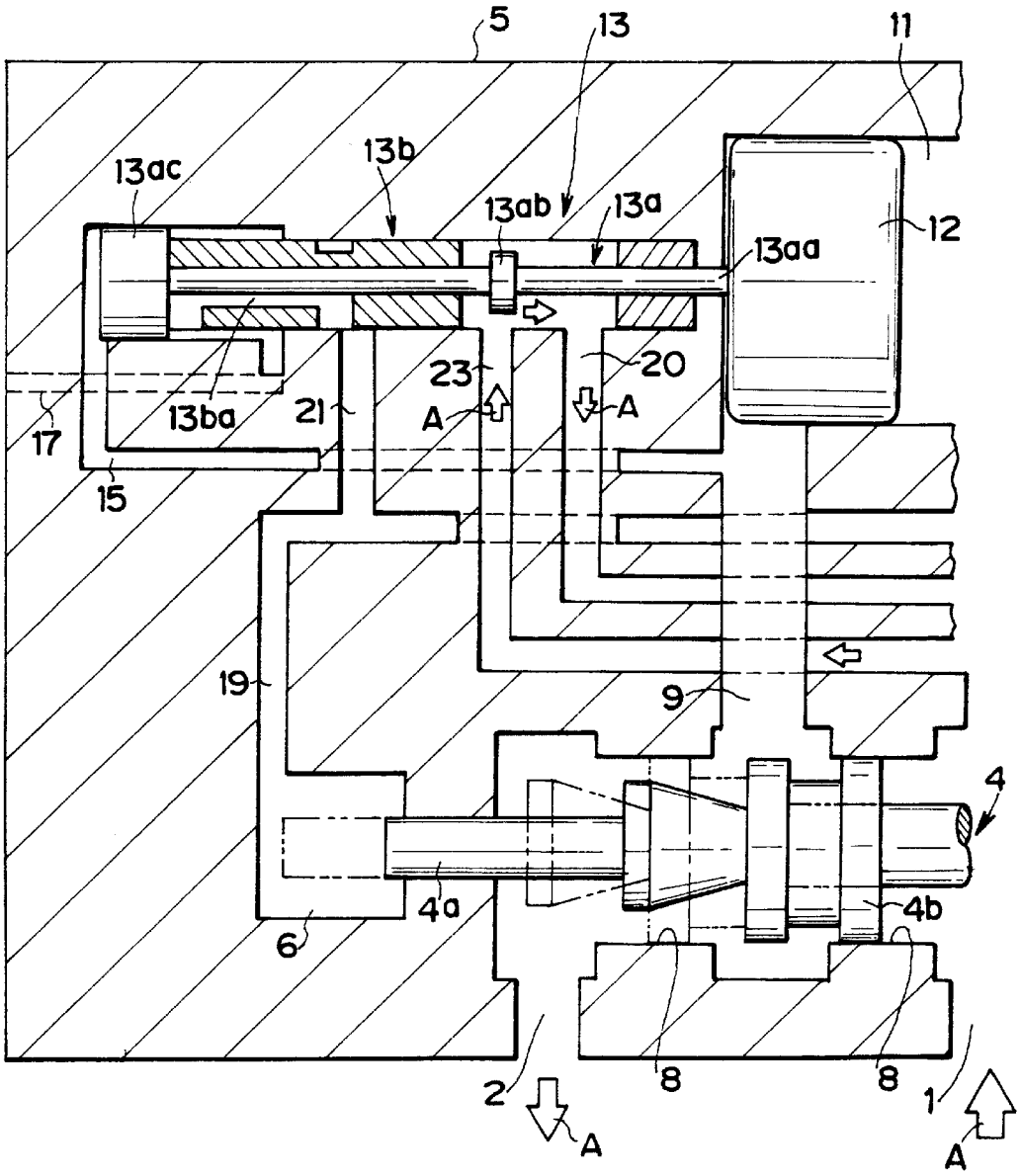
FIG. 3 shows the state of finishing the operation of FIG. 2.

When the operating piston 12 changes from the state shown in FIG. 2(C) to the state of stopping as shown in FIG. 3, the pressurized fluid A introduced into the front end side of the second pilot unit 13*b* through the pressure supplying passages 23 flows into the pressure passage 20 and fills up the right pressure chamber 7, thus to push the right side end portion of the shaft 4*a* of the switching valve 4. Consequently, the switching valve 4 which assumes its right position is automatically turned to its left position.

That is to say, the operating piston 12 is pushed by the pressurized fluid A introduced into the left main passage 9 communicating with the inlet port 1, thus to move rightward within the operating chamber 11. As a result, the pressurized fluid A is discharged from the right outlet port 3. At this time, the left outlet port 2 is closed by the switching valve 4.

Figure 4:
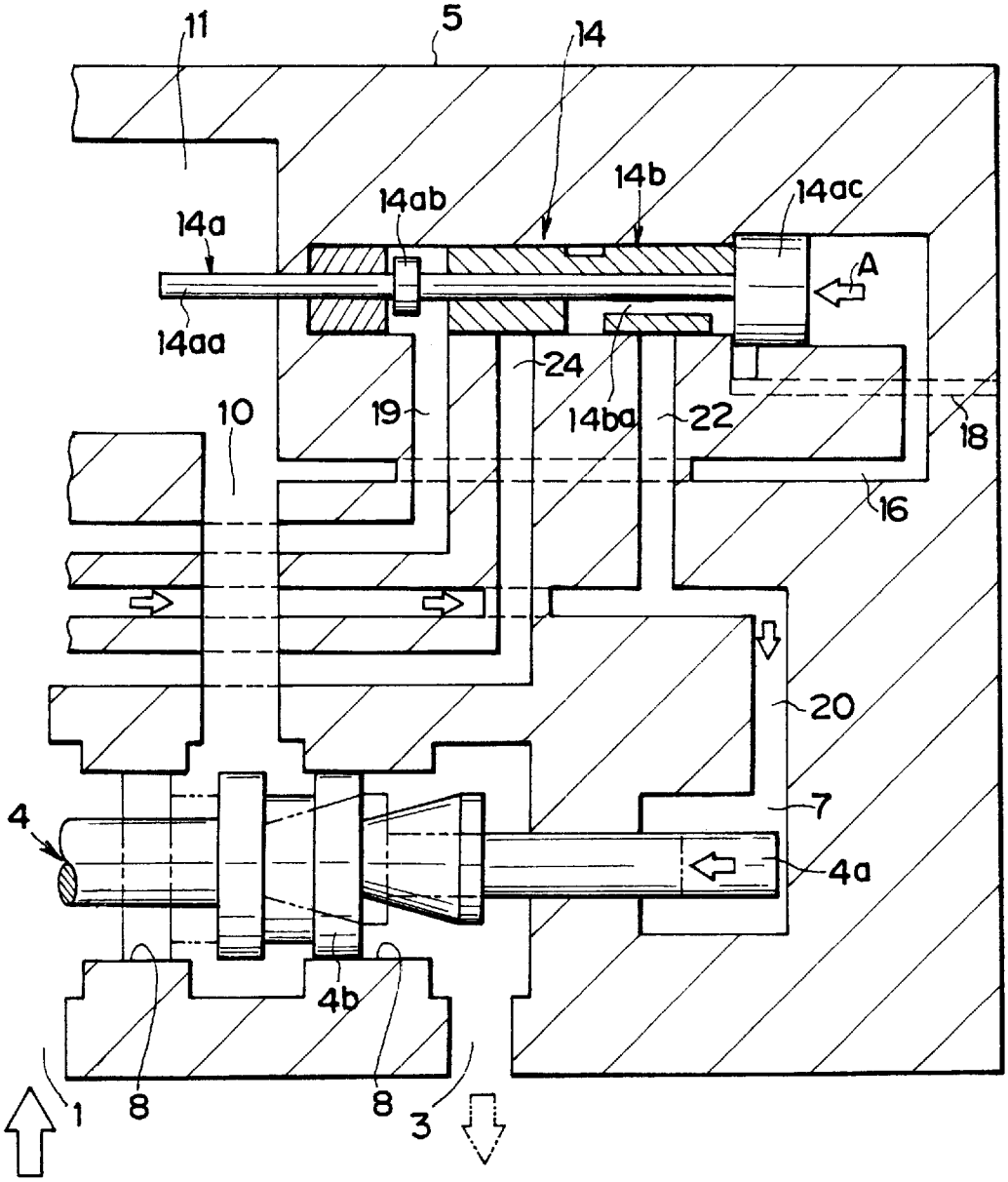
FIG. 4 shows the state of finishing the operation of the principal portion of the counterpart of FIG. 2.

At the time of switching the switching valve 4, the right pilot valve 14 moves forward by the pressure of the pressurized fluid A from the pilot passage 16 communicating with the right main passage 10, as shown in FIG. 4. Thus, the right pressure release passage 22 is not connected with the discharge port 14*ba* of the second pilot unit 14*b*, and thus, isolated from the discharge passage 18. As a result, pressure loss of the pressurized fluid A filled in the right pressure chamber 7 can be prevented.

On the other hand, the left pressure release passage 21 is connected with the discharge port 13*ba* of the second pilot unit 13*b* to communicate with the discharge passage 17, as shown in FIG. 3. As a result, the pressurized fluid A filled in the left pressure chamber 6 is discharged from the discharge passage 17, to decrease resistance of the pressurized fluid A applied to the left side end portion of the shaft 4*a* of the switching valve 4.

Figure 5:
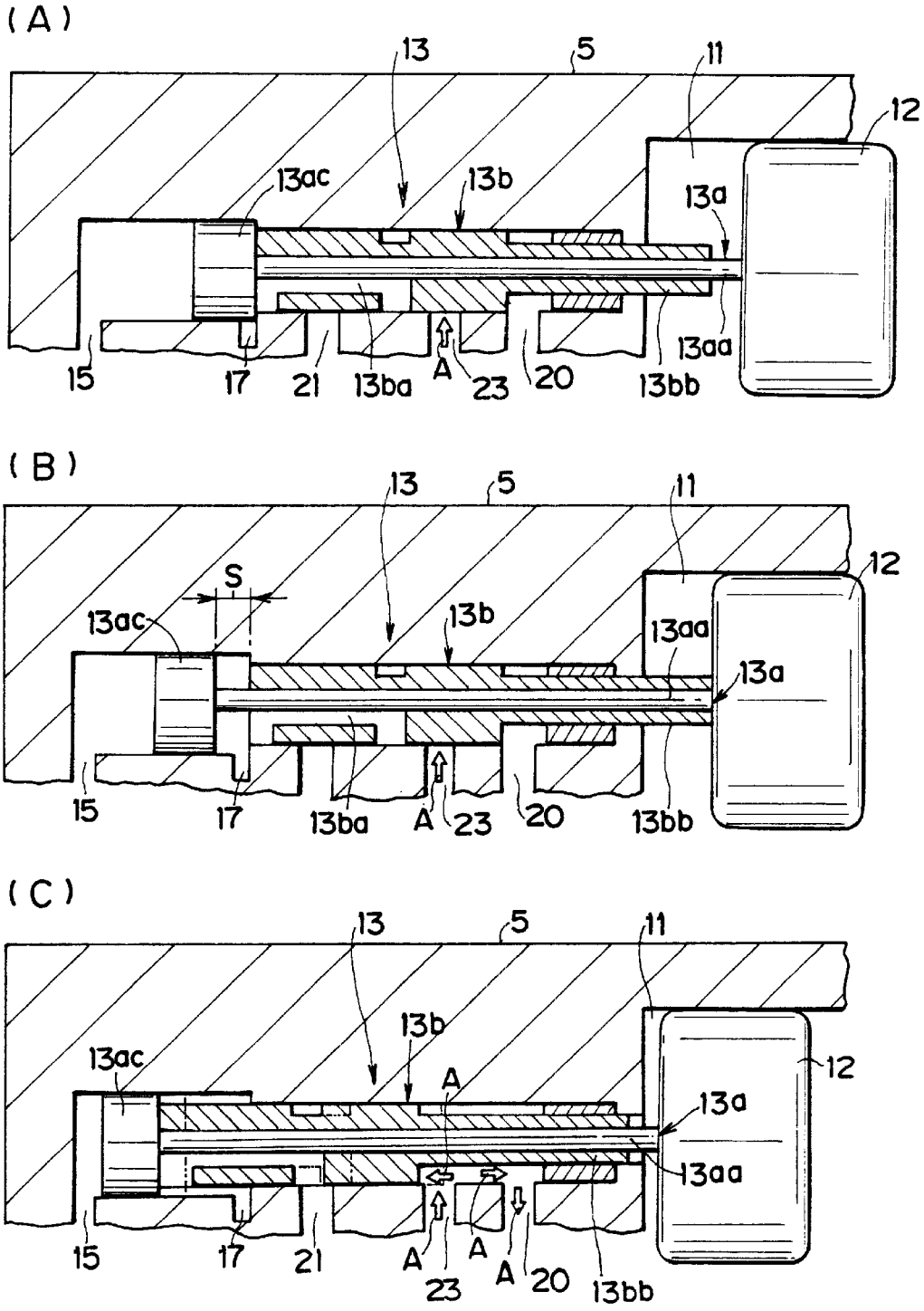
FIG. 5 is a sectional view showing a second embodiment of the best mode for carrying out the automatic pressurized fluid switching device, showing the sequence of operation of the device in the order of (A) to (C).

FIG. 5 illustrates the second embodiment of the invention.

The pilot valves 13 and 14 in this illustrated embodiment are modified from those of the foregoing first embodiment.

The first pilot units 13*a* and 14*a* of the pilot valves 13 and 14 in this embodiment are not provided with the flanges 13*ab* and 14*ab* found in the first embodiment.

The second pilot units 13*b* and 14*b* of the pilot valves 13 and 14 in this embodiment are each formed of a sleeve, which has length slightly shorter than that from the front end to the rear end of the respective push rods 13*aa* and 14*aa* of the first pilot unit 13*a* and 14*a*. The front end portions 13*bb* and 14*bb* of the respective sleeves are made small in diameter and brought in contact with the operating piston 12 within the operating chamber 11.

In this manner, the pilot units 13*a* and 14*a* and the second pilot units 13*b* and 14*b* can be made compact.

Besides, the front end portions 13*bb* and 14*bb* of the second pilot unit can bring about the same function and effect as the flanges 13*ab* and 14*ab* of the first pilot units 13*a* and 14*a* in the first embodiment described above.

Furthermore, the passages connected with the pressure passages 19 and 20, pressure supplying passages 23 and 24, inlet port 1, and outlet ports 2 and 3 may be arbitrarily modified in various ways.

INDUSTRIAL APPLICABILITY

The present invention is applicable to all sorts of pressurized fluid such as oil, air and gas.

The switching mechanism for discharging the pressurized fluid according to the invention can be used for not only a reciprocating drive device for a fluid pressure cylinder, but also a fluid pressure pump, a fluid pressure compressor and the like.

What is claimed is:

1. An automatic pressurized fluid switching device comprising an inlet port for introducing pressurized fluid, a plurality of outlet ports for discharging the pressurized fluid, a switching valve disposed between said inlet port and said outlet ports for switching over said outlet ports, a pilot valve for piloting switching operation of said switching valve, and a reaction member for controlling pilot action of said pilot valve in response to pressure of the pressurized fluid introduced, characterized in that said pilot valve is provided with a first pilot unit in which the pilot action of said pilot valve is controlled only by said reaction member, and a second pilot unit in which the pilot action of said pilot valve is controlled by said reaction member in its initial and final stages and directly by the pressurized fluid in its middle stage.

2. An automatic pressurized fluid switching device according to claim 1, wherein said reaction member comprises an operating piston mounted in a reciprocative sidable state within an operating chamber formed between said inlet port and said outlet ports, each of said first pilot units of said pilot valve comprises a push rod having a front portion which protrudes into said operating chamber to come in touch with said operating piston, a flange formed in the middle of said push rod, and a pilot piston mounted at the rear portion to receive the pressure of the pressurized fluid, and each of said second pilot units of said pilot valve is formed of a sleeve fitted sidably in the rear portion side of said push rod, said sleeve being shorter than length from said flange of said push rod to the rear end thereof so as to control the pressure of the pressurized fluid applied to said switching valve.

3. An automatic pressurized fluid switching device according to claim 1, wherein that the reaction member comprises an operating piston mounted in a reciprocative sidable state within an operating chamber formed between said inlet port and said outlet ports, each of said first pilot units of said pilot valve comprises a push rod having a front portion which protrudes into said operating chamber to come in touch with said operating piston, a flange formed in the middle of said push rod, and a pilot piston mounted at the rear portion to receive the pressure of the pressurized fluid, and each of said second pilot units of said pilot valve is formed of a sleeve fitted sidably in the rear portion side of said push rod, said sleeve being slightly shorter than length from the vicinity of the front portion to the rear portion of said push rod of said first pilot unit so as to control the pressure of the pressurized fluid applied to said switching valve.

* * * * *